US007568470B2

(12) United States Patent
Kamito et al.

(10) Patent No.: US 7,568,470 B2
(45) Date of Patent: Aug. 4, 2009

(54) FUEL SYSTEM FOR OUTBOARD MOTOR

(75) Inventors: Hidemasa Kamito, Shizuoka-ken (JP); Hiroyuki Tsunekawa, Shizuoka-ken (JP); Shintaro Kawaguchi, Shizuoka-ken (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/617,668

(22) Filed: Dec. 28, 2006

(65) Prior Publication Data

US 2007/0240686 A1 Oct. 18, 2007

(30) Foreign Application Priority Data

Apr. 17, 2006 (JP) ..... 2006-113772

(51) Int. Cl.
*F02M 37/04* (2006.01)
*F01N 7/00* (2006.01)

(52) U.S. Cl. ..... 123/509; 440/88 A; 440/88 F

(58) Field of Classification Search ..... 440/88 A, 440/88 F; 123/509, 510, 514
See application file for complete search history.

(56) References Cited

U.S. PATENT DOCUMENTS

| | | | | |
|---|---|---|---|---|
| 3,835,822 | A * | 9/1974 | Mickle et al. | 123/41.31 |
| 5,797,378 | A * | 8/1998 | Kato | 123/516 |
| 5,819,711 | A * | 10/1998 | Motose | 123/516 |
| 5,832,903 | A * | 11/1998 | White et al. | 123/514 |
| 6,561,773 | B1 * | 5/2003 | Fischer | 417/366 |
| 7,401,598 | B2 * | 7/2008 | Ochiai | 123/516 |
| 2003/0013359 | A1 * | 1/2003 | Suganuma et al. | 440/77 |

FOREIGN PATENT DOCUMENTS

JP 11-091689 4/1999

* cited by examiner

*Primary Examiner*—Stephen K Cronin
*Assistant Examiner*—J. Page Hufty
(74) *Attorney, Agent, or Firm*—Keating & Bennett, LLP

(57) ABSTRACT

A boat has an outboard motor that is mounted to a hull and has a fuel system. The outboard motor has a cowling housing an engine. The fuel system includes a fuel pump disposed within a sealed container. The sealed container provides a physical and thermal barrier to seawater and engine heat that may otherwise degrade fuel pump operation. The sealed container can also include an internal insulator.

21 Claims, 8 Drawing Sheets

FUEL SYSTEM FOR OUTBOARD MOTOR

RELATED APPLICATIONS

The present application is based on and claims priority under 35 U.S.C. § 119(a)-(d) to Japanese Patent Application No. 2006-113772, filed on Apr. 17, 2006, the entire contents of which is hereby expressly incorporated by reference herein.

BACKGROUND OF THE INVENTION

1. Field of the Invention

The present invention relates to fuel systems for a boat having an outboard motor.

2. Description of the Related Art

Known outboard motors have a fuel pump for supplying fuel between the fuel tank and the engine (see Patent Document JP-A-11-091689). A cowling typically surrounds the motor, and fuel pump is located within the cowling and is exposed to engine heat. An insulator wound around the fuel pump inhibits the fuel from vaporizing due to the engine heat. However, seawater can enter the cowling and accumulate near the fuel pump. The structure described in Patent Document JP-A-11-091689 cannot completely prevent the accumulated seawater from passing through gaps in the insulator and contacting the fuel pump. This contact may lead to corrosion of the fuel pump. In the fuel system above, there is also a risk that the insulator itself may deteriorate due to sea water exposure.

SUMMARY OF THE INVENTION

A need exists for a fuel system that reduces the chance of moisture contacting the fuel pump and the insulator in order to extend the life of these components.

An aspect of the invention involves an outboard motor for a boat that outboard motor includes a cowling defining an engine compartment and houses an engine. The compartment includes a fuel delivery conduit which supplies fuel to the engine. The outboard motor includes a fuel pump disposed within the fuel delivery conduit. The fuel pump delivers the fuel to the engine from a hull side of the boat. The fuel pump is enclosed by a sealed container that is disposed at a bottom of the engine compartment.

Another aspect of the invention involves a boat that includes a hull and an outboard motor mounted to the hull. The boat includes a cowling that houses an engine. The boat further includes a sealed container in the cowling and a fuel pump disposed in the sealed container.

An addition aspect of the invention involves a fuel system for an outboard motor having an engine. The fuel system includes a sealed container disposed inside the outboard motor and a fuel pump disposed in the sealed container.

BRIEF DESCRIPTION OF THE DRAWINGS

These and other features, aspects and advantages of the present invention will now be described in connection with preferred embodiments of the invention, in reference to the accompanying drawings. The illustrated embodiments, however, are merely an example and are not intended to limit the invention. The following is a brief description of the drawings.

DETAILED DESCRIPTION OF THE PREFERRED EMBODIMENTS

Figure 1:
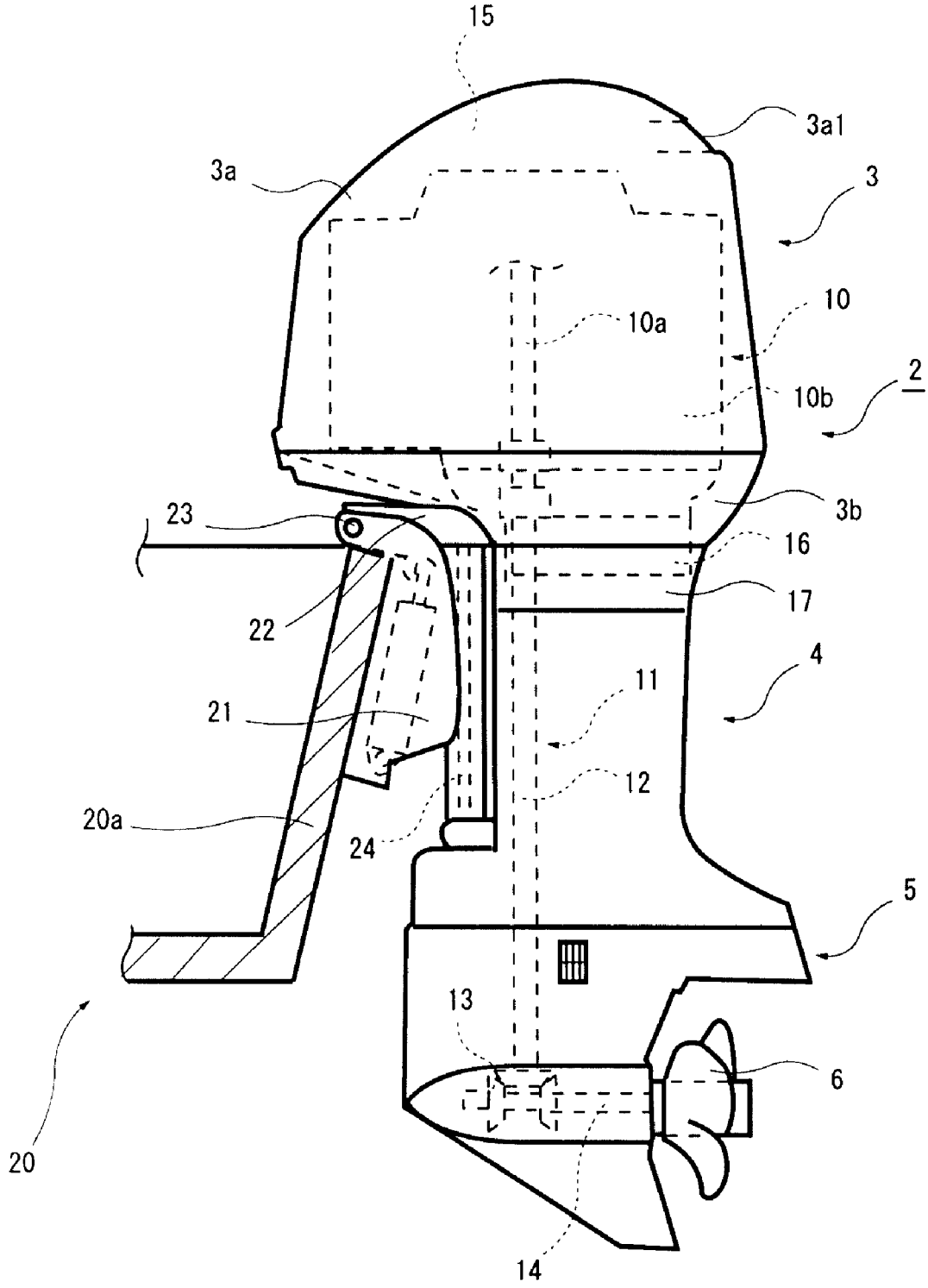
FIG. 1 is a side view of an outboard motor configured in accordance with a preferred embodiment of the present invention, illustrated as attached to a transom of a boat with some internal components shown in phantom lines.

The following detailed description is now directed to certain specific embodiments of the invention, In this description, reference is made to the drawing wherein like parts are designated with like numerals throughout the description and the drawing.

FIG. 1 is a schematic view of a boat having a fuel system configured in accordance with a preferred embodiment of the present invention. The boat includes a hull 20 and an outboard motor 1. The outboard motor 1 is mounted to the hull 20 by a bracket 21. The clamping bracket 21 is fixed to a transom board 20*a* of the hull 20. A tilt shaft 23 couples a swivel bracket 22 with the clamping bracket 21 so that the clamping bracket 21 supports the swivel bracket 22 for pivotal movement about an axis of the tilt shaft 23.

A front side of the outboard motor 1 is positioned on a hull side of the boat, while a rear side of the outboard motor 1 is positioned on the opposite side of the hull 20. The horizontal direction is generally the direction of travel for the boat. The vertical direction is generally perpendicular to the horizontal direction.

The outboard motor 1 includes a propulsion unit 2. The swivel bracket 22 carries the propulsion unit 2 for pivotal movement about an axis of a steering shaft 24. The housing of the propulsion unit 2 is formed by a cowling 3, an upper casing 4, and a lower casing 5. The cowling 3 encloses an engine 10. The engine 10 includes a crankshaft 10*a*.

Figure 2:
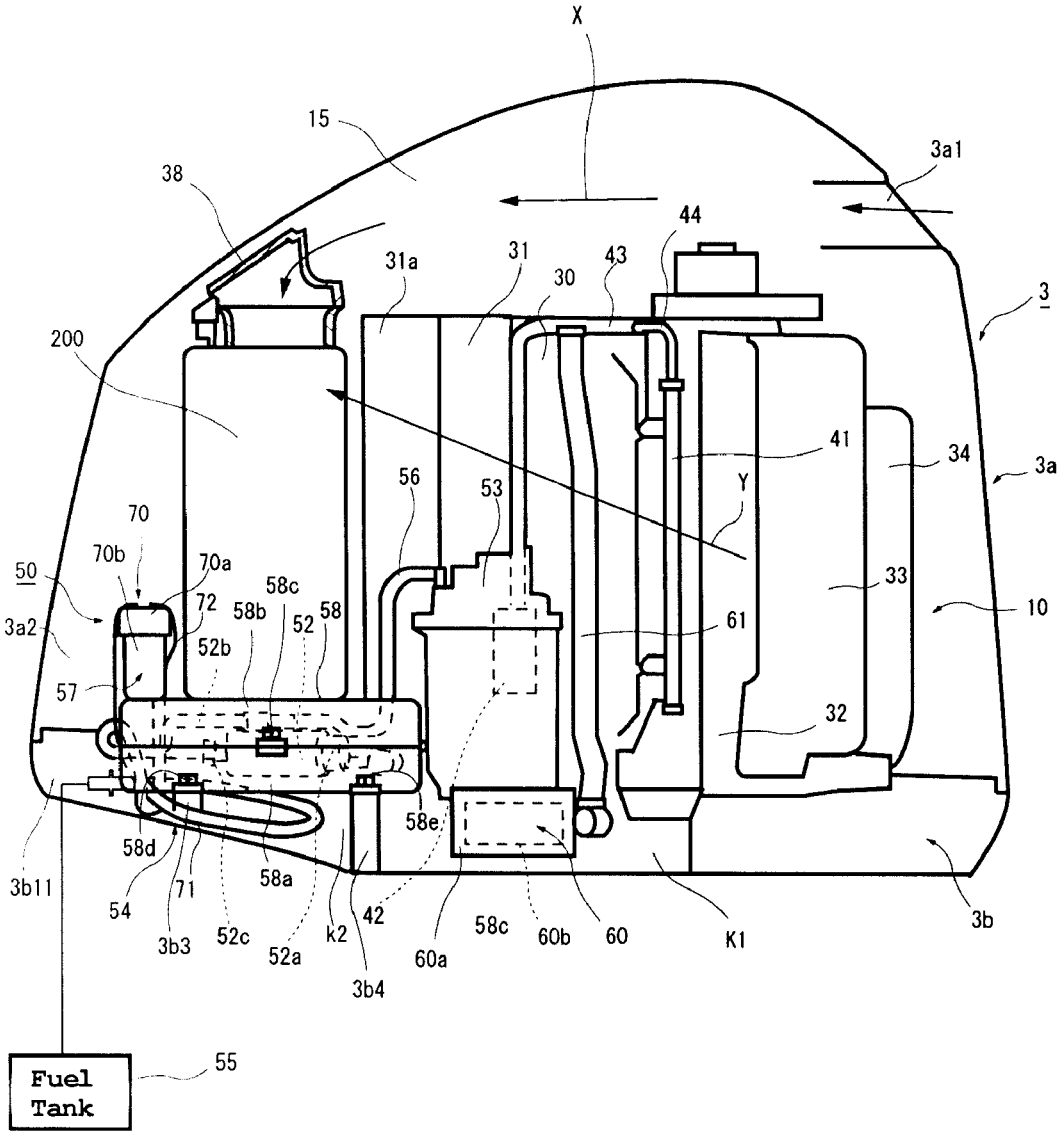
FIG. 2 is an enlarged side sectional view of an upper portion of the outboard motor from FIG. 1 showing and engine and an associated fuel supply system.

FIG. 2 is a schematic view of an upper portion of the outboard motor 1 from FIG. 1 showing the fuel system. As most clearly shown in FIG. 2, the crankshaft 10*a* is positioned between the hull 20 and the cylinders 10*b* of the engine 10. A power transmission mechanism 11 and exhaust passages (not shown) extend from the engine 10 and through the upper casing 4 and the lower casing 5. The power transmission mechanism 11 includes a driveshaft 12, a mode shifting mechanism 13 and a propeller shaft 14. The power from the engine 10 rotates a propeller 6 through the power transmission mechanism 11.

The cowling 3 defines an engine compartment 15 and includes a top cowling member 3*a* and a bottom cowling member 3*b*. The top cowling member 3*a* includes an air intake opening 3*a*1. Air entering the intake opening 3*a*1 is routed to the engine 10 and engine compartment 15. An exhaust guide 16 is disposed at a top end of the upper casing 4. The engine 10 is fixed to a top surface of the exhaust guide 16.

In the illustrated embodiment, an apron 17 is attached to a top portion of the upper casing 4 and to the exhaust guide 16. The top cowling member 3*a* covers the engine 10 and preferably is removably attached to the bottom cowling member 3*b*. The bottom cowling member 3*b* is fixed to the exhaust guide 16.

Figure 3:
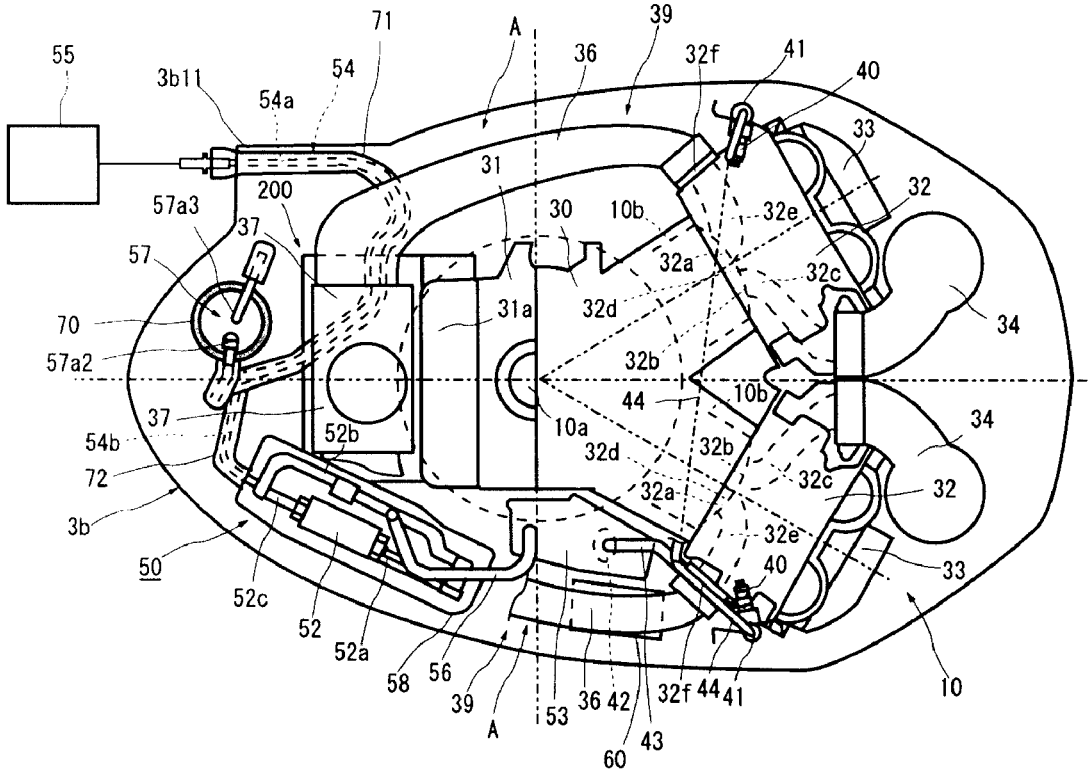
FIG. 3 is a top plan view of the outboard motor from FIG. 2 showing the V-shape arrangement of the engine of the outboard motor.
Figure 4:
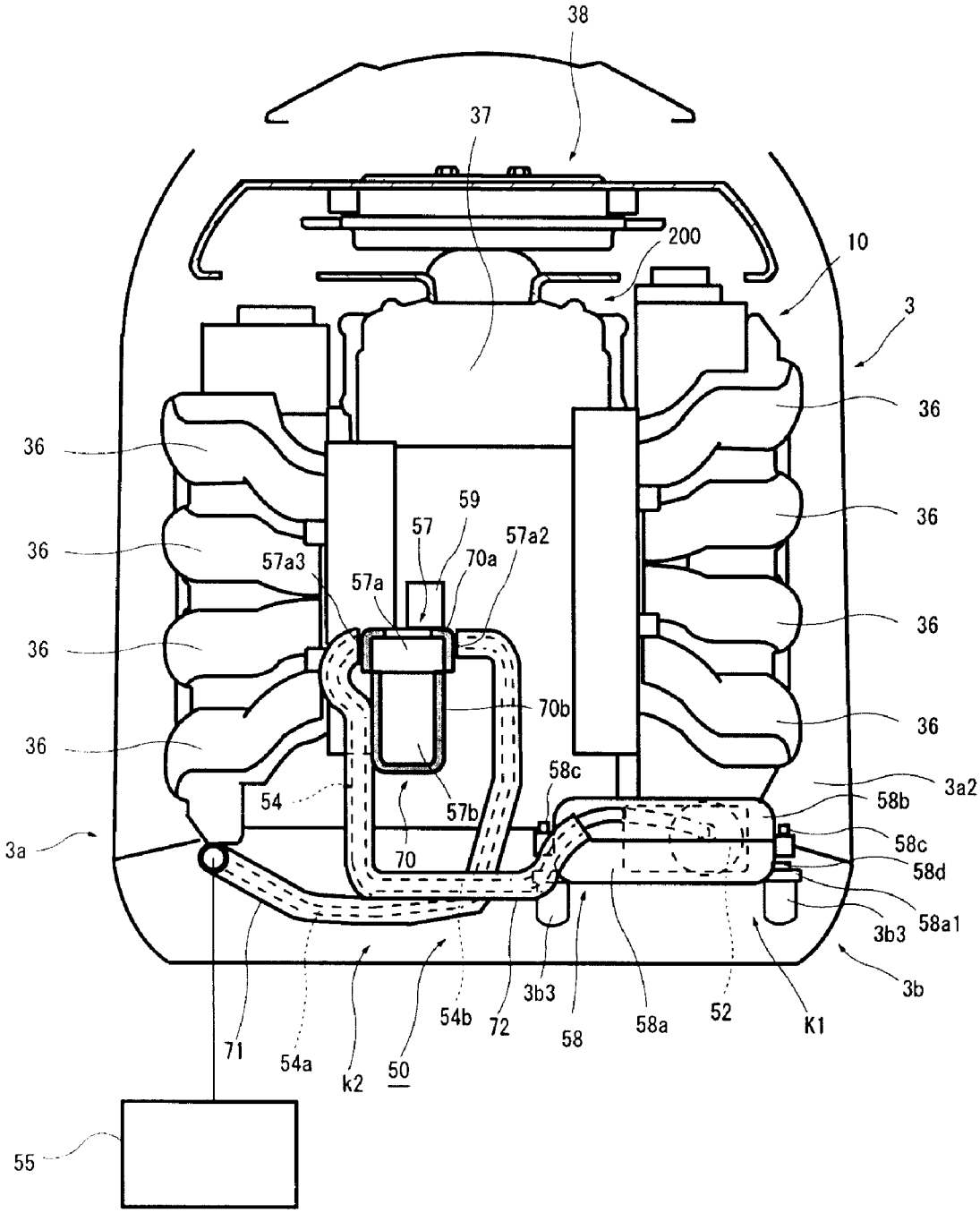
FIG. 4 is a front view of the outboard motor from FIG. 2.

FIG. 3 is a top plan view of the outboard motor 1 from FIG. 2 showing the V-shape arrangement of the engine 10 of the outboard motor 1. FIG. 4 is a front view of the outboard motor 1 from FIG. 2. As shown in FIGS. 2 through 4, the exemplary engine 10 is a four stroke, V-type, eight-cylinder engine. Of course the invention is not limited to a specific engine type or arrangement of cylinders.

The outboard motor 1 is mounted to the transom board 20*a* of the boat 20 so as to be movable between a running position, in which the crankshaft 10*a* extends substantially in a vertical direction, and a tilt-up position, in which the propeller 6 is raised out of the water.

A crankcase 31 is attached to a front mating surface of a cylinder block 30 of the engine 10. A crankcase cover 31*a* is attached to the crankcase 31. Cylinder heads 32 are attached to the rear mating surfaces of the cylinder block 30. A head cover 33 covers an opening to each cylinder head 32. The head covers 33 and the cylinder heads 32 are directed generally in a rearward direction away from the hull 20.

The cylinder block 30 includes right and left cylinders 10*b*. The cylinders 10*b* are arranged in a V-shape and extend toward the crankshaft 10*a*. Each cylinder head 32 has one or more intake valve openings 32*a* and exhaust valve openings 32*b* for the respective cylinder. The respective intake valve openings 32*a* and the exhaust valve openings 32*b* communicate with combustion chambers 32*d* defined in the V-shaped banks.

Exhaust gas exits the exhaust valve openings 32*b* and is routed to a space defined between the V-shaped banks through respective exhaust ports 32*c*. The exhaust gases from each bank are merged into individual exhaust manifolds 34 located in the space. Exhaust gases are discharged through the exhaust manifolds 34 and to the body of water below the engine. The intake manifolds 36 have been omitted from FIG. 2.

The intake valve openings 32*a* for the respective banks are in flow communication with intake ports 32*e* passing through the respective cylinder heads 32. An intake manifold 36 connects to each outside connecting opening 32*f* of the respective intake port 32*e*. The intake manifold 36 may include a bent portion 39 that is in flow communication with the intake port 32*e* and a surge tank 200. As is shown most clearly in FIG. 3, intake passages "A" extend in a forward direction.

The illustrated embodiment includes a throttle body 37 that contains a throttle valve (not shown). The throttle body 37 connects to the surge tank 200. An intake silencer 38 is connected to an upstream portion of the throttle body 37. Of course the invention is not limited to a specific type of fuel delivery system and may be employed with fuel systems that include a carburetor or another type of fuel injection (e.g. direct injection).

Fuel injectors 40 are located in the intake ports 32*e* of the cylinder heads 32 in the respective cylinders. An injection nozzle of each fuel injector is directed toward the respective combustion chamber 32*d*. Tubular fuel delivery rails 41 are disposed in such a manner that each rail 41 is oriented toward the crankshaft 10*a* and is positioned outside of the respective cylinder head 32.

A fuel supply device 50 supplies fuel to the fuel injectors 40. In the illustrated embodiment, the fuel supply device 50 includes a fuel filter 57, a low pressure primary pump 52 built in a sealed container 58, and a vapor separator 53.

The low pressure primary pump 52 delivers fuel from a fuel tank 55 to the vapor separator 53. The pump 52 creates positive pressure in the fuel lines, pushing the fuel to the engine. The pump 52 includes a housing having an inlet and an outlet. For an electric fuel pump, an electric motor and impeller may be located within the housing. The electric motor drives the impeller which causes fuel to enter the inlet and exit via the outlet.

The fuel passes through a low pressure fuel delivery conduit 54*a*, a fuel filter 57, and a low pressure fuel delivery conduit 54*b* before reaching the vapor separator 53. Surplus fuel is expelled from a discharge port 52*a* of the primary pump 52 and returned to a suction port 52*c* of the primary pump 52 through a return passage 52*b*.

The primary pump 52 delivers the fuel through a fuel delivery conduit 56 to a high pressure secondary pump 42. The fuel pressurized by this secondary pump 42 is delivered to the ends of the right and left fuel delivery rails 41 through a high pressure fuel delivery conduit 43 and a right-left bifurcated hose 44. The fuel is injected into each combustion chamber 32*d* during a period in which the injection nozzle of the respective fuel injector 40 is opened.

Figure 5:
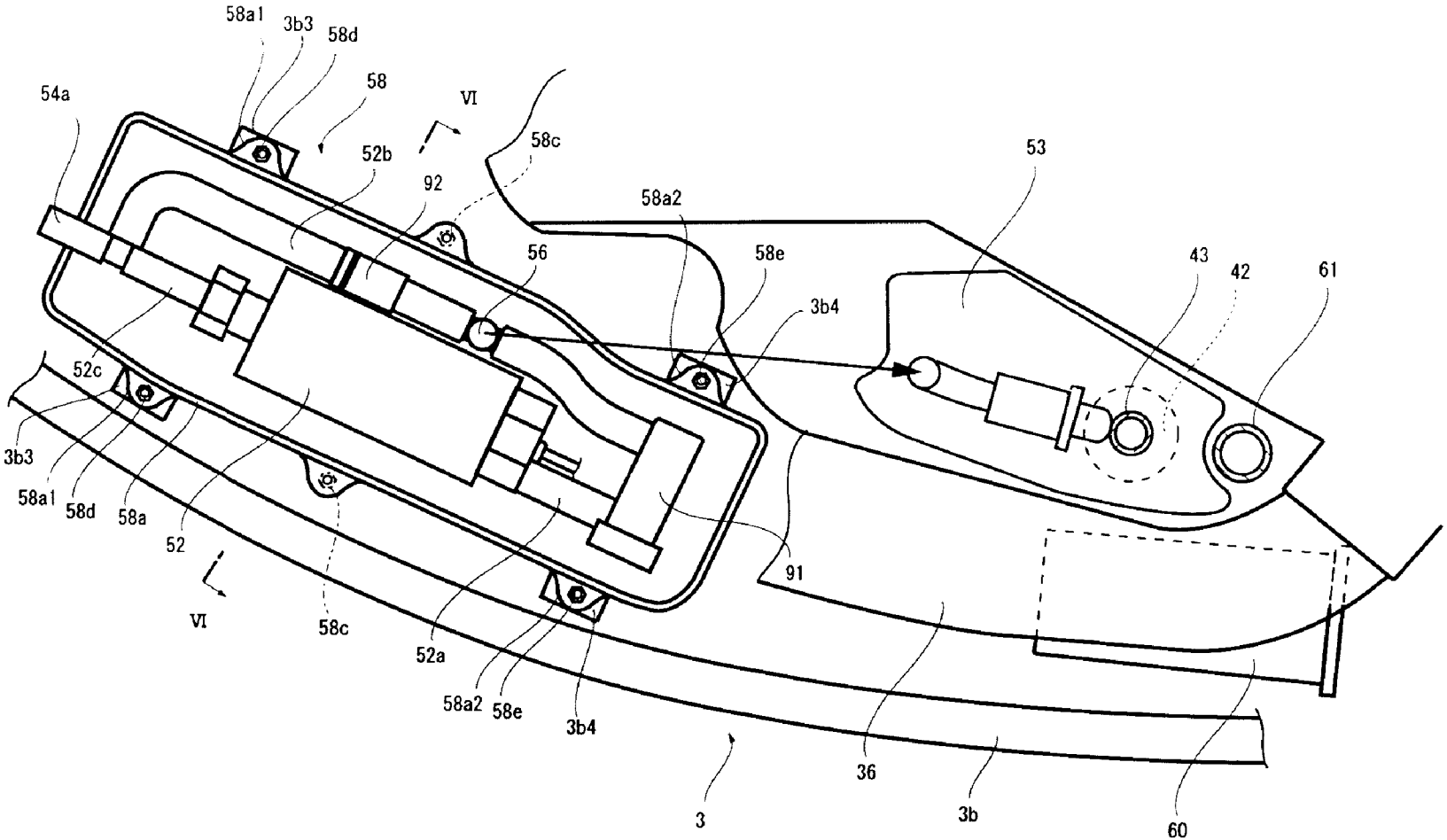
FIG. 5 is a partial top plan view of the upper portion of the outboard motor of FIG. 3 including a sealed container, a vapor separator and a canister.
Figure 6:
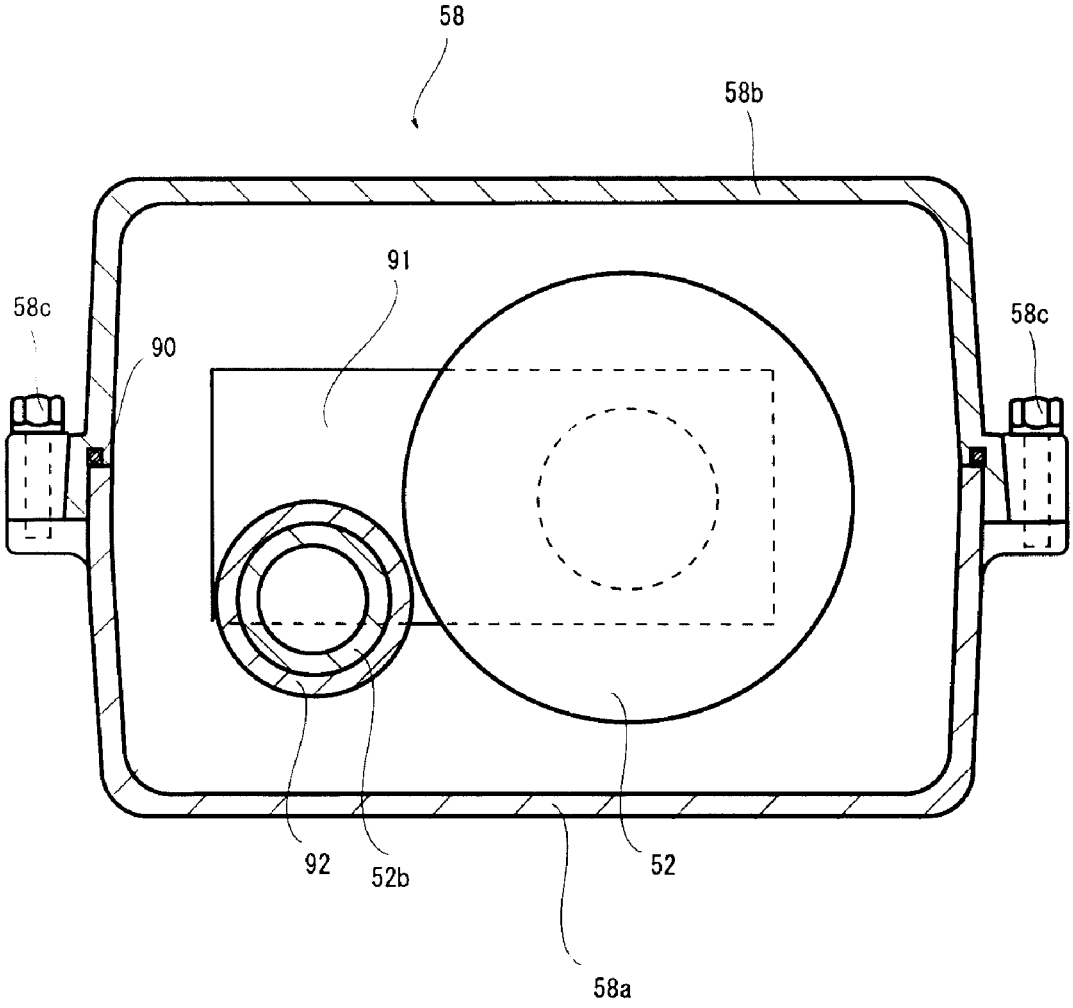
FIG. 6 is an enlarged cross sectional view taken along the line VI-VI of FIG. 5.

FIG. 5 is a partial top plan view of the outboard motor 1 from FIG. 3 and shows a sealed container 58, a vapor separator 53, and a canister 60. FIG. 6 is a cross sectional view taken along the line VI-VI of FIG. 5. The sealed container 58 includes a container body 58*a* and a container lid 58*b*. The container body 58*a* and container lid 58*b* can be made of resin or other suitable material, and can of the same material that forms at least part of the cowling 3. The container body 58*a* and the container lid 58*b* are tightly coupled together preferably using bolts 58*c* and an O-ring 90. The container body 58*b* and the container lid 58*b* can be decoupled from each other.

In the illustrated embodiment, the primary pump 52 is disposed near the center of the sealed container 58. The fuel is expelled through a discharge port 52*a* of the primary pump 52. Fuel from a filter 91 is pumped to the vapor separator 53 through the fuel delivery conduit 56. The filter 91 preferably removes at least a portion of any foreign substances in the fuel. The return passage 52*b* preferably extends along a lateral side wall of the sealed container 58.

A regulator 92 is disposed in the return passage 52*b*. The regulator 92 maintains a constant pressure in the fuel delivery conduits. Because of the pressure adjustment with the regulator 92, a surplus amount of fuel expelled from the primary pump 52 is returned to the suction port 52*c* of the primary pump 52.

As shown in FIGS. 2, 4 and 5, the illustrated embodiment of the container body 58*a* includes mount portions 58*a*1, 58*a*2 near its corners. Bolts 58*d* fasten the front mount portions 58*a*1 to mount bosses 3*b*3 in the bottom cowling member 3*b*. Bolts 58*e* fasten the rear mount portions 58*a*2 to mount bosses 3*b*4 on the bottom cowling member 3*b*. As a result, the sealed container 58 can be disposed at the bottom of the engine compartment 15. The sealed container 58 may be positioned on the opposite side of the cylinder heads 32 with respect to the crankshaft 10*a* of the engine 10 and fixed to the bottom cowling member 3*b* in the cowling 3. Further, the sealed container 58 may be positioned on the left side of the crankcase 31 of the engine 10 with a portion of the sealed container 58 being located in front of the crankcase 31 in the cowling 3. This arrangement allows a worker, user, or mechanic to easily remove the top cowling member 3*a* while standing in the boat to access the sealed container 58. This also allows the worker to more easily perform maintenance on the sealed container 58.

The mount bosses 3*b*4 preferably are longer than the mount bosses 3*b*3 so that the sealed container 58 is generally level even though a center portion of the bottom cowling 3*b* is lower than a peripheral portion thereof. The primary pump 52 enclosed in the interior of the sealed container 58 is also generally level or horizontal. The discharge port 52*a* may be positioned on the rear side of the primary pump 52. The fuel delivery conduit 54*b* extends through the container lid 58*b* and is connected to the suction port 52*c* on the front side thereof. The discharge port 52*a* through which the fuel is discharged is positioned to be directed generally rearward in the outboard motor.

The primary pump 52 preferably is electrically operable. An electric fuel pump 52 may be more easily located within the sealed container 58 since the engine 10 need not drive the electric fuel pump. In same embodiments, however, the fuel pump can be driven by power supplemented by the engine 10.

The sealed container 58 encloses the primary pump 52. The sealed container 58 may also be disposed at the bottom of the engine compartment 15 away from the engine 10. Even though water may enter and accumulate in the engine compartment 15, the sealed container 58 protects the primary pump 52 from moisture which may corrode or seize the pump improving durability.

The sealed container 58 may also insulate the primary pump 52 from engine heat. Because the sealed container 58 is positioned at the bottom of the engine compartment 15, any water that may accumulate in the bottom of the engine compartment 15 advantageously cools the sealed container 58 and the primary pump 52.

As most clearly shown in FIG. 2, air "X" flows from the air intake opening 3*a*1 toward the intake air silencer 38. Air heated by the engine 10 "Y" also flows toward the air intake opening 3*a*1. Because the primary pump 52 is positioned out of the path of the heated air "Y", the primary pump 52 is less likely to be heated by the air flowing along the X and Y paths. Also, because the primary pump 52 extends generally horizontally, the entire pump can be positioned lower in the engine compartment 15 and further from the heated air.

In addition, the discharge port 52*a* of the primary pump 52 is preferably disposed as the rearward side of the pump 52 in the engine compartment 15. When the outboard motor 1 is in a tilt-up position, for example when the associated boat is moored, the discharge port is placed at a higher position so that vaporizing gasses do not stay in the primary pump 52. In this position, fuel is less likely to reverse flow.

The sealed container 58 may be mounted to the bottom cowling member 3*b* and positioned on the opposite side of the cylinder head 32 with respect to the crankshaft 10*a* of the engine 10 in the cowling 3. The sealed container 58 can be efficiently cooled since the sealed container 58 is spaced apart from the exhaust system. A worker, a user, a mechanic or the like can easily remove the top cowling member 3*a* from the bottom cowling member 3*b* and also decouple the container lid 58*b* from the container body 58*a* of the sealed container 58 to set the primary pump 52 even while standing in the hull since the sealed container 58 is positioned at the side of the engine 10 closer to the hull in the cowling 3. That is, the assembling work and any replacement or maintenance work on the primary pump 52 is easier to perform. Because the sealed container 58 encloses at least the filter 91 and the regulator 92, the filter 91 and regulator 91 are insulated from engine heat, Preferably, the primary pump 52, the filter 91 and the regulator 92 are assembled within the single sealed container 58 so as to reduce the number of assembly steps. The primary pump 52 may be positioned anywhere between the fuel tank 55 on the side of the hull and the vapor separator 53 which provides design flexibility. More preferably, the primary pump is positioned within the cowling 3 of the outboard motor 1.

A canister 60 is attached securely to the vapor separator 53. The canister 60 includes a case 60*a*. The case 60*a* is connected to the vapor separator 53 and is filled with an absorbent 60*b* such as, for example, active carbon. Vapors in the vapor separator 53 enter the canister 60 and are absorbed by the absorbent 60*b*. The air from which the fuel is separated by absorption is discharged through a discharge pipe 61 to the interior of the cowling 3.

In the illustrated embodiment, the canister 60 is disposed below the lower most portion of the intake manifold 36 and on the left side. As shown in FIGS. 2 and 4, the vapor separator 53 and the canister 60 are disposed in a dead space K1 formed by the V-shaped banks on the left side of the cylinder block 30. The area occupied by the fuel system components is reduced by positioning the canister 60 below the intake manifold 36. This arrangement further allows the width of the top cowling member 3*a* to be reduced.

As best seen in FIG. 3, the fuel filter 57 may be positioned on the opposite side of the cylinder heads 32 with respect to the crankshaft 10*a* of the engine 10 within the cowling 3. That is, the fuel filter 57 is disposed on the side of the surge tank 200 closer to the hull 20. The fuel filter 57 is preferably positioned lower than the air intake opening 3*a*1 in the top cowling member 3*a*. Preferably, the fuel filter 57 is positioned adjacent to a bottom opening 3*a*2 in the top cowling member 3*a*.

With respect to FIGS. 2-4, the fuel filter 57 includes a body section 57*a*, a cap section 57*b* and a filter section 57*c*. The body section 57*a* is preferably fastened to a bracket 59. The bracket 59 is fixed to the side of the surge tank 200 closer to the hull 20. A female screw may be formed in a recess 57*a*4 of the body section 57*a*, while a male screw may be formed on an attaching portion of the cap section 57*b*. The cap section 57*b* thus is detachably fixed to the body section 58*a* by the screwed structure. The body section 57*a* has an inlet port 57*a*2 and an outlet port 57*a*3. The low pressure fuel delivery conduit 54*a* is connected to the inlet port 57*a*2, while the low pressure fuel delivery conduit 54*b* is connected to the outlet port 57*a*3.

An insulating section 70 of heat insulating material preferably covers the fuel filter 57. For example, the insulating section 70 may be made of foam rubber or the like. The insulating section 70 preferably has a shape similar to the outer shape of the fuel filter 57. The insulating section 70 may be formed from one or more pieces. For example, a first piece 70*a* may cover the body section 57*a* while a second piece 70*b* covers the cap section 57*b*. The first piece 70*a* covering the body section 57*a* may have a shape that matches the outer shape of the body section 57*a*, while the second piece 70*b* that covers the cap section 57*b* has a shape that matches the outer surface of the cap section 57*b*.

The fuel filter 57 is insulated by the heat insulating section 70 from engine heat to avoid fuel vaporization. Preferably the inside surface of the heat insulating section 70 matches the outer surface of the fuel filter 57 to minimize gaps between the two surfaces which improves the heat insulation efficiency. The piece 70*a* covering the body section 57*a* and the piece 70*b* covering the cap section 57*b* can be separately and easily attached to the associated sections 57*a*, 57*b* of the fuel filter 57. Also, when the cap section 57*b* is removed for cleaning from the body section 57*b* or when the filter section 57*c* is replaced, the insulating section 70 is easily attached to the fuel filter 57. Thus, assembly and maintenance work is easier.

Because the fuel filter 57 is positioned on the side of the engine 10 closer to the hull in the cowling 3, a worker, a user, a mechanic or the like can easily attach the fuel filter 57 by removing the top cowling member 3*a*. The assembling work can be done easily, and the replacement or maintenance work on the filter 57 is also easy to perform. Preferably, the fuel filter 57 is spaced apart from the exhaust manifolds 34 to reduce any heating of the fuel filter 57 by the engine 10.

The fuel filter 57 is preferably positioned lower than the air intake opening 3*a*1 of the top cowling member 3*a* through which the air enters the engine 10. Although the air "Y" heated by the engine 10 also flows in the engine compartment 15 of the cowling 3, the fuel filter 57 is located out of the path of air "Y." Therefore, the fuel filter 57 can be further inhibited from being heated by the engine 10.

Additional heat insulating sections 71, 72 may cover at least a portion of the fuel delivery conduit 54 connected to the fuel filter 57, i.e., the fuel delivery conduits 54*a*, 54*b*. The fuel delivery conduit 54*a* extends through a right front portion 3*b*11 of the bottom cowling member 3*b* to enter the interior thereof. The fuel delivery conduit 54*a* may have a bend in the vicinity of the surge tank 200 and extend below the surge tank 200. The fuel delivery conduit 54*a* extends upward from below the fuel filter 57 and connects to the inlet port 57*a*2 on the left side of the fuel filter 57. The fuel delivery conduit 54*b* is connected to the outlet port 57*a*3 on the right side of the fuel filter 57 and extends downward along the fuel filter 57. The fuel delivery conduit 54*b* may further extend below the fuel filter 57 and connect to the primary pump 52 in the sealed container 58.

As shown in FIGS. 2 and 4, the low pressure fuel delivery conduit 54*a* and the low pressure fuel delivery conduit 54*b* are located within the dead space K2 around the fuel filter 57 and below the surge tank 200. The low pressure fuel delivery conduit 54*a* and the low pressure fuel delivery conduit 54*b* are preferably covered with the insulating sections 71, 72, respectively. Thus, the insulated fuel conduit 54 inhibits the fuel from being heated. Preferably the portion of the fuel delivery conduit 54 connected to the low pressure primary pump 52 is covered with the insulating sections 71, 72. The fuel delivery conduits 54*a*, 54*b* are more susceptible to generating vapors if heated because the fuel passing there through is at a negative pressure due to the low pressure primary pump 52. Heating of the fuel can be inhibited due to the fuel delivery conduits 54*a*, 54*b* being insulated by insulating sections 71, 72.

The insulating sections 70, 71, 72 may be made of foam rubber or the like, Even if water enters the cowling 3, the heat insulation and the durability of the insulators 70, 71, 72 can be maintained. In addition, the insulators 70, 71, 72 are inexpensive, and easy to assemble and attach.

Figure 7:
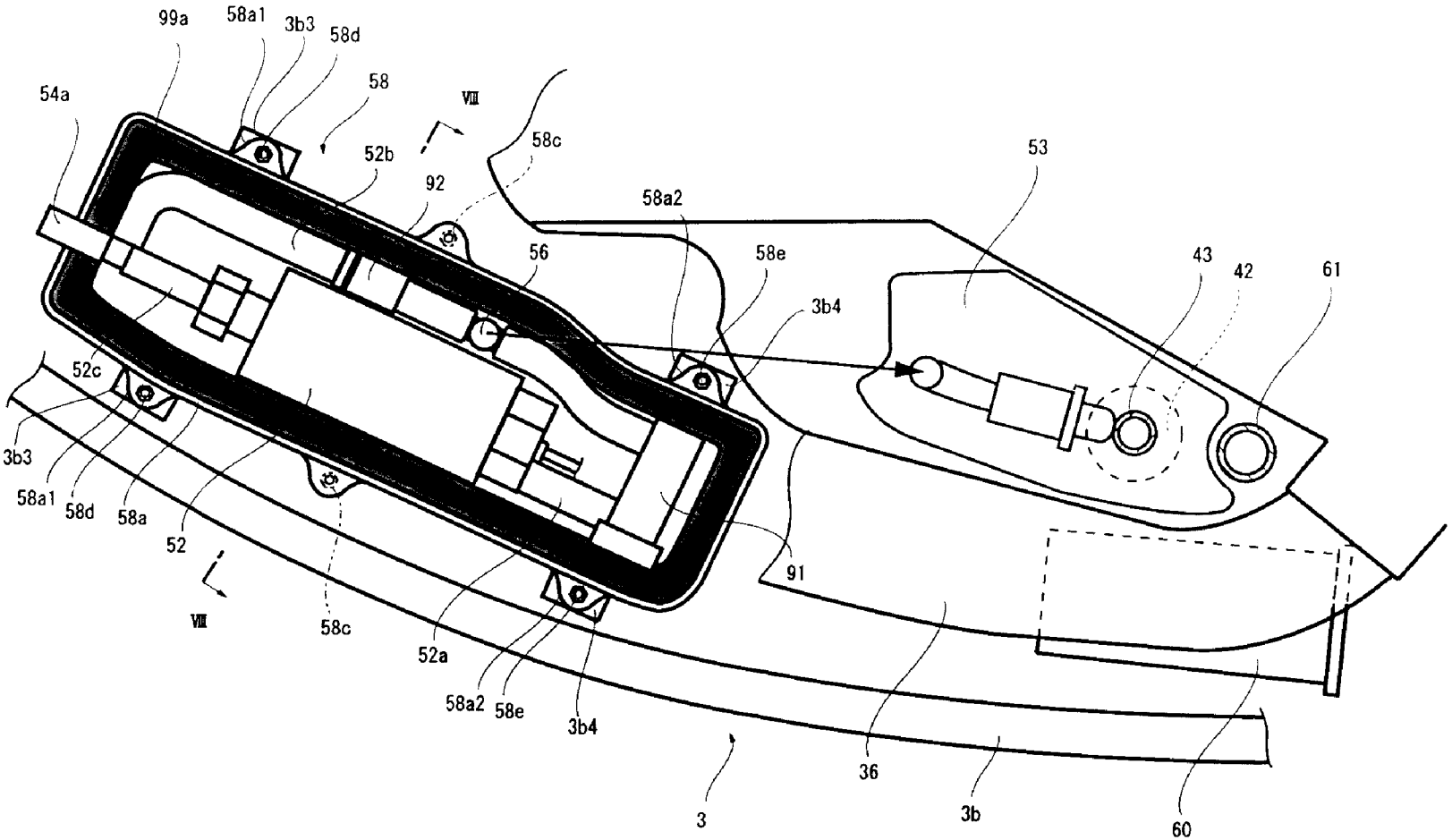
FIG. 7 is a partial top plan view of an upper portion of another outboard motor that has a fuel supply system configured in accordance with another embodiment of the present invention.
Figure 8:
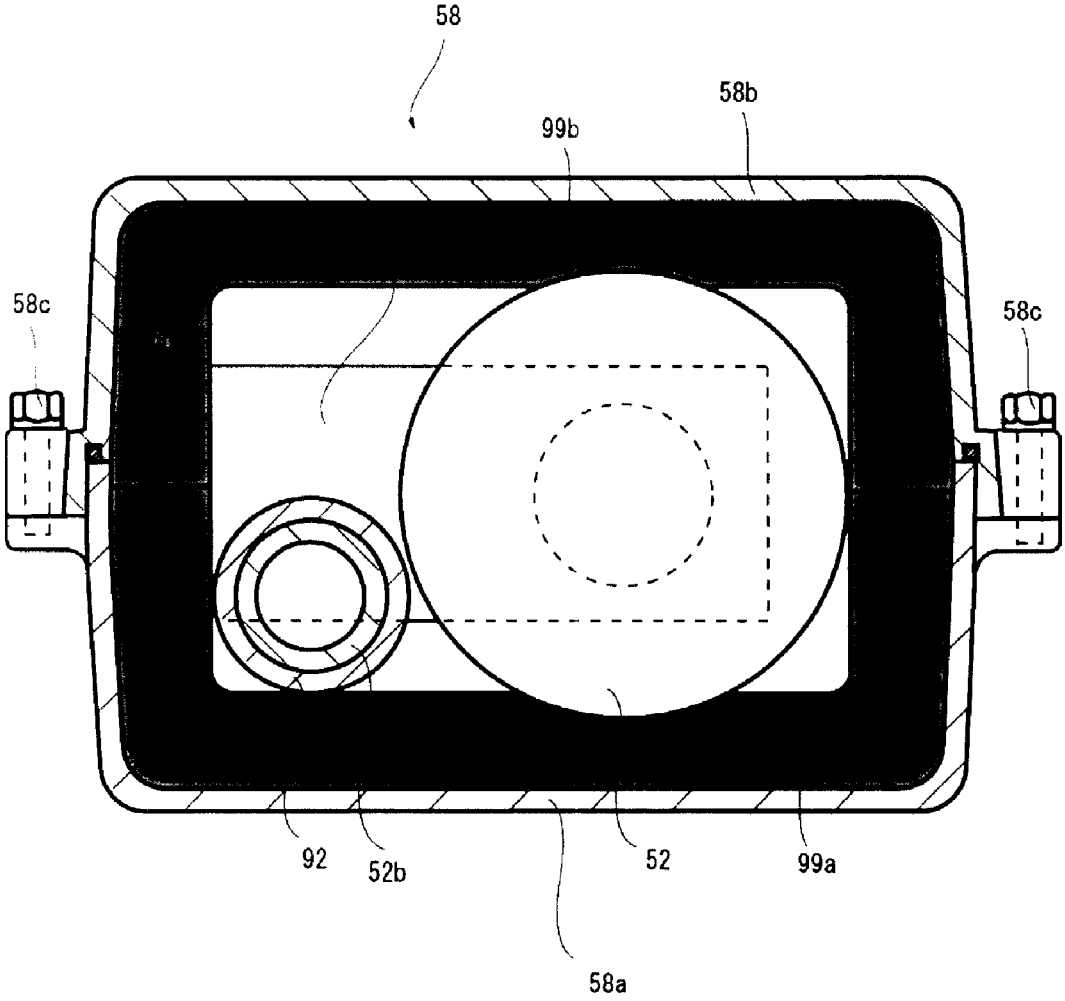
FIG. 8 is a cross sectional view taken along the line VIII-VIII of FIG. 7 and through a heat insulator.

FIG. 7 is a partial top plan view of an outboard motor 1 having a fuel system configured in accordance with another embodiment of the present invention that includes a heat insulator 99*a*. FIG. 8 is a cross sectional view taken along the line VIII-VIII of FIG. 7 and through the heat insulator 99*a*. In this embodiment, the structures of the primary pump 52, the filter 91, the regulator 92 and the return passage 52*b* are the same as those of the embodiment shown in FIGS. 1-6. The same reference numerals and symbols thus are assigned so as to omit further description.

The sealed container 58 in this embodiment has a heat insulator 99*a* positioned inside the container body 58*a* and a heat insulator 99*b* positioned inside the container lid 58*b*. Because the insulators 99*a*, 99*b* insulate the primary pump 52, the regulator 92, the filter 91 and the return passage 52*b*, the fuel is inhibited form being heated by the engine. The insulators 99*a*, 99*b* may be made from, for example, foam rubber, foam polyurethane or the like.

The embodiment illustrated in FIGS. 7 and 8 provides additional thermal isolation to the components within the sealed container 58. This additional thermal isolation may be particularly advantageous for larger outboard motors when, for example, the temperature in the cowling 3 exceeds the temperature in the sealed container 58 due to the heat of the engine. It may also be particular advantageous when the cooling effect from water accumulating in the cowling 3 is not present. For example, water accumulation in the cowling 3 is rare when the outboard motor runs on a water surface having small waves such as on a lake.

This invention provides a simple structure that can be applied to an outboard motor having a fuel supply device for supplying fuel to an engine, and can insulate and shield a fuel pump to improve the pump's durability, Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof.

In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Thus, it is intended that the scope of the present invention herein disclosed should not be limited by the particular disclosed embodiments described above, but should be determined only by a fair reading of the claims.

What is claimed is:

1. An outboard motor for a boat, comprising:

a cowling defining an engine compartment;

an engine disposed in the engine compartment;

a first fuel delivery conduit, at least a portion of the first fuel delivery conduit being disposed in the engine compartment and receiving fuel from a fuel tank on a hull side of the boat;

a first fuel pump receiving the fuel from the first fuel delivery conduit;

a second fuel delivery conduit, at least a portion of the second fuel delivery conduit being disposed in the engine compartment and receiving at least a portion of the fuel from the first fuel pump;

a second fuel pump receiving the fuel from the second fuel delivery conduit and delivering the fuel to the engine;

a vapor separator being disposed in the engine compartment with the second fuel pump being enclosed by the vapor separator; and a sealed container being disposed at a bottom of the engine compartment with the first fuel pump being enclosed by the sealed container, the sealed container being secured to the cowling.

2. The outboard motor according to claim 1, wherein the sealed container is positioned on an opposite side of a crankshaft of the engine from a cylinder head of the engine.

3. The outboard motor according to claim 1, wherein at least a portion of the sealed container is positioned in front of a crankcase of the engine.

4. The outboard motor according to claim 1, wherein the first fuel pump has an elongated shape that extends generally in a horizontal direction.

5. The outboard motor according to claim 1 further comprising a discharge port, the discharging port being directed rearward of the engine.

6. The outboard motor according to claim 1, wherein the first fuel pump includes an electric motor.

7. The outboard motor according to claim 1, wherein the first fuel pump feeds fuel to the vapor separator that is connected to the second fuel delivery conduit.

8. The outboard motor according to claim 1 further comprising:

a fuel filter that is connected to the fuel delivery conduit; and a regulator for maintaining pressure within at least one of the first and second fuel delivery conduits, at least a portion of each of the fuel filter and the regulator being disposed within the sealed container.

9. An outboard motor comprising:

an outboard motor being configured to be mounted to a boat hull and having a cowling, the cowling housing an engine;

a sealed container located within the cowling and being secured to the cowling;

a vapor separator located within the cowling;

a first fuel pump disposed in the sealed container and configured to discharge fuel at a first pressure value; and a second fuel pump disposed in the vapor separator and configured to receive fuel discharged by the first fuel pump and discharge the received fuel at a second pressure value, the second pressure value being greater than the first pressure value.

10. The outboard motor according to claim 9 further comprising an engine compartment, the sealed container being disposed at the bottom of the engine compartment.

11. The outboard motor according to claim 9, wherein the sealed container is positioned on an opposite side of a crankshaft of the engine from a cylinder head of the engine.

12. The outboard motor according to claim 9, wherein at least a portion of the sealed container is positioned in front of a crankcase of the engine.

13. The outboard motor according to claim 9, wherein the first fuel pump has an elongated shape that extends generally in a horizontal direction.

14. The outboard motor according to claim 9, wherein the first fuel pump includes an electric motor.

15. The outboard motor according to claim 9 further comprising:

a fuel filter that is in fluidic communication with the first fuel pump; and a pressure regulator arranged in a fluid delivery conduit communicating with the first fuel pump, the fuel filter and the pressure regulator being disposed within the sealed container.

16. The outboard motor according to claim 9 further comprising a heat insulator, at least a portion of the heat insulator being disposed between the sealed container and the first fuel pump.

17. A fuel system for an outboard motor having a cowling that houses an engine, the fuel system comprising:

a sealed container disposed inside the outboard motor and being secured to the cowling;

a low pressure fuel pump, which has an electric motor, disposed in the sealed container;

a vapor separator disposed inside the outboard motor; and a high pressure fuel pump disposed in the vapor separator.

18. The fuel system according to claim 17 further comprising a heat insulator, at least a portion of the heat insulator being disposed between at least part of the sealed container and at least part of the low pressure fuel pump.

19. The fuel system according to claim 18, wherein the heat insulator comprises a foam material.

20. The fuel system according to claim 19 further comprising a filter and a pressure regulator, at least portions of the heat insulator being disposed between the sealed container and both the filter and the pressure regulator.

21. The outboard motor according to claim 1, wherein a portion of the second fuel delivery conduit passes through the sealed container at a location between ends of the sealed container.

* * * * *